United States Patent [19]

Peterson

[11] 3,984,037

[45] Oct. 5, 1976

[54] HAND OPERATED GARMENT HANGER HAVING SIMPLIFIED CLOSURE MEANS

[76] Inventor: Eldon L. Peterson, 4631 E. B St., Tacoma, Wash. 98404

[22] Filed: May 19, 1975

[21] Appl. No.: 578,572

[52] U.S. Cl. ..... 223/96

[51] Int. Cl.[2] ..... A47J 51/14

[58] Field of Search ..... 223/96, 91, 93

[56] References Cited

UNITED STATES PATENTS

| | | | |
|---|---|---|---|
| 2,209,864 | 7/1940 | Warren | 223/96 |
| 2,496,238 | 1/1950 | Ullrich | 223/96 |

FOREIGN PATENTS OR APPLICATIONS

| | | | |
|---|---|---|---|
| 384,036 | 10/1923 | Germany | 223/96 |
| 432,105 | 3/1948 | Italy | 223/96 |
| 643,229 | 9/1950 | United Kingdom | 223/96 |

*Primary Examiner*—George H. Krizmanich
*Attorney, Agent, or Firm*—Eugene D. Farley

[57] ABSTRACT

A garment hanger comprising paired hook means. Shoulder bars medially join the hook means and connect at their extremities to depending legs which terminate in gripping means arranged to engage a garment portion for hanging of the garment. Closure means is rotatably joined to one of the shoulder bars and has a finger portion which may be positioned over the other shoulder bar to place the gripping means in a closed position securing the garment. The closure means is configured for one-finger operation making the hanger readily operable with one hand.

3 Claims, 2 Drawing Figures

HAND OPERATED GARMENT HANGER HAVING SIMPLIFIED CLOSURE MEANS

BACKGROUND OF THE INVENTION

This invention relates to an improvement in garment hangers. It especially relates to garment hangers capable of one-hand operation.

Garment hangers of the class of the present invention are well known in the prior art. One such is disclosed in my prior patent, U.S. Pat. No. 3,865,287.

The previous garment hangers capable of one-hand operation, however, have been of a complicated nature and are expensive to fabricate. Generally they require a special hanger construction to facilitate operation of the closing mechanism; utilization of a spring biasing system of one sort or another; and the application of a relatively complex closing mechanism.

The prior closing mechanisms have normally employed a cam or over-center lever arrangement for closure. Devices of this type deteriorate with wear to the point that after continued use they no longer will retain the hung garment.

Accordingly, the general object of the present invention is to provide a garment hanger capable of one-hand operation.

It is a further object of the present invention to provide such a garment hanger that is simple of operation, having a closure system that can be fabricated from bent wire, or similar materials.

It is a further object of the present invention to provide such a garment hanger having closure means wherein the operation is not appreciably affected by wear.

THE DRAWINGS

The manner in which the foregoing and other objects of the invention are accomplished will be apparent from the accompanying specification and claims considered together with the drawings wherein:

FIG. 1 is a pictorial view of the garment hanger of the present invention with the closure means in the open position; and FIG. 2 is an end elevation view of the garment hanger with the closure means in the closed position.

GENERAL STATEMENT OF THE INVENTION

The present invention provides a garment hanger for one-hand operation which comprises paired hook means having lower end portions which are joined substantially normal to the medial portions of associated shoulder bars. Legs depend from the end portions of the shoulder bars and attach to gripping means configured for clamping and holding a garment.

Closure means is rotatably joined to one of the shoulder bars and includes a finger portion which may be positioned over the other shoulder bar to lock the gripping means releasably in a closed position, securing the garment therein.

The closure means is configured for operation with one finger, leaving the rest of the user's hand free to manipulate the gripping means. The other hand is thus free to position the garment within the garment hanger.

DETAILED DESCRIPTION OF A PREFERRED EMBODIMENT

Figure 1:
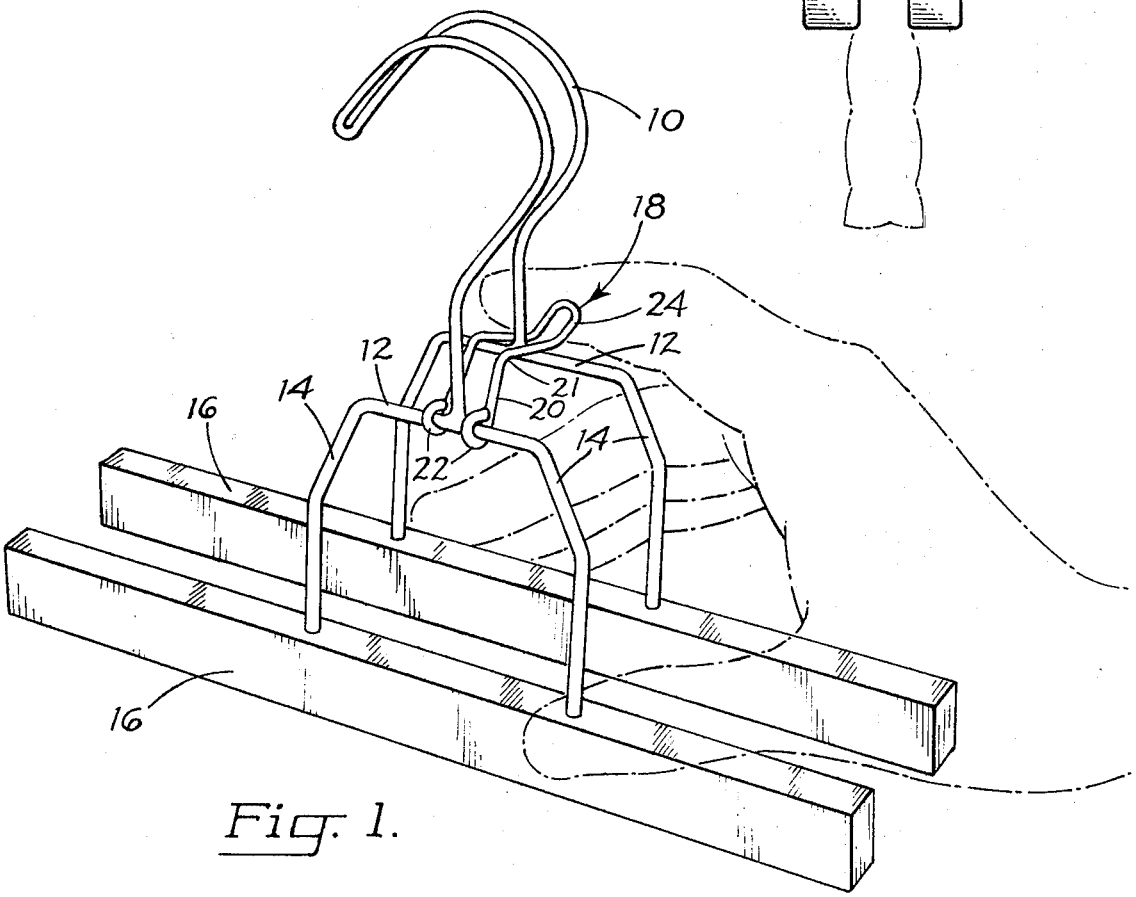

Referring to FIG. 1 of the drawings, the garment hanger of the present invention comprises paired hook means 10 consisting of curved upper portions and short, straight, end portions. The curved upper portions of paired hook means 10 are configured to support the garment hanger when it is in use. I prefer to form the paired hook means from a single length of stiff wire reversely bent in its medial portion.

Shoulder bars 12 are joined in their medial portions substantially normal to the short, straight, end portions of paired hook means 10. The shoulder bars are preferably formed from lengths of wire, and are integrally attached to the paired hook means, as by welding.

Legs 14 depend from the end portions of shoulder bars 12. Legs 14 are shown in FIG. 1 as having an upper, angled portion and a lower, straight portion. This arrangement is a matter of preference, and other configurations such as straight or curved legs could be utilized. The legs also are preferably formed from lengths of wire and are integral with the shoulder bars.

It is to be noted that while the aforesaid elements of the garment hanger of the present invention are shown as being formed of wire, other materials may be substituted. One of the main features of the present invention, however, is that it does allow the garment hanger to be fabricated from a material such as wire which is inexpensive and easy to fabricate.

Gripping means are attached to the lower portions of legs 14. The gripping means comprise cooperating clamps 16 of sufficient size and rigidity to maintain a hung garment. One of the clamps is generally located below each shoulder bar and is substantially parallel thereto.

For clamps I prefer to employ bars of wood. In this case, legs 14 may be attached to the gripping means by glueing them into holes placed in the clamps.

Closure means 18 is rotatably joined to one of the shoulder bars and has a finger portion 20 which extends over the other shoulder bar. For closure means I prefer a length of wire, similar to that used in the other elements, reversely bent in its medial portion. Both end portions of the wire are looped around one of the shoulder bars to form eyes 22. To prevent lateral displacement of the closure means, I prefer to position one of the eyes on each side of one of the straight end portions of paired hook means 10. The bent medial portion of the closure means correspondingly is fitted around the other straight end portion of paired hook means 10.

When paired hook means 10 are formed from a bent piece of wire, they serve to bias shoulder bars 12 apart to the position shown in FIG. 1. Therefore, when the closure means is rotated over one of the shoulder bars, to place the garment hanger in a closed or partially closed position, the frictional engagement between the closure means and the shoulder bar caused by this biasing effect prevents the closure means from being forced to an open position.

Figure 2:
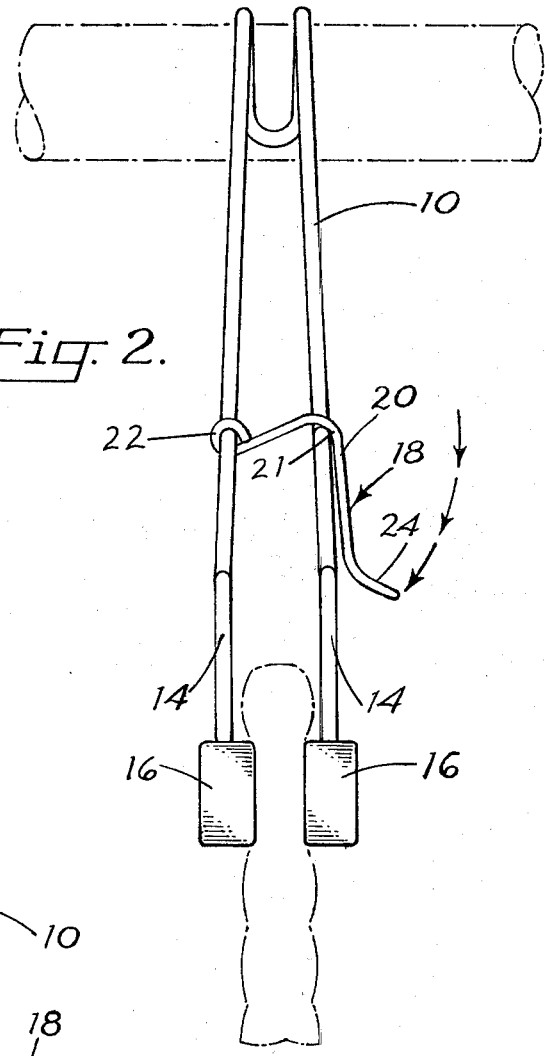

Closure means 18 is substantially L-shaped forming pocket 21. When the closure means is rotated to the completely closed position, as shown in FIG. 2, pocket 21 receives the shoulder bar to lock the clamps releasably in a closed position. Once placed in this position the closure means must be manually operated by the user in order to open the garment hanger.

The end of closure means 18 is slightly contoured to provide finger grip 24 which assists the user in operation of the closure means. The finger grip enables the user to hook one finger thereover, as shown in FIG. 1, and secure the garment within the garment hanger with a single hand.

According to the present invention, a portion of a garment is readily mounted on the hanger by first releasing closure means 18 to the position shown in FIG. 1 to open clamps 16. The garment portion is then placed between the clamps and closure means 18 is rotated to its closed position, as shown in FIG. 2, to secure the garment therebetween.

To open the garment hanger the user need only push upward on finger grip 24 to rotate the closure means to its open position. The paired hook means then bias clamps 16 apart to release the hung garment. The opening is again performed with only one of the user's fingers leaving the remainder of his hand free to manipulate the garment.

As noted, the gripping means can be placed in an open or closed position with a single finger, thus allowing the remainder of that hand and the other hand free to suitably manipulate the garment portion within the gripping means.

It is to be noted that the simplicity of the garment hanger of the present invention allows the closure mechanism to be made of wire or other loose tolerance materials without sacrificing gripping power when in the closed position.

It is also to be noted that operation of the garment hanger is not lessened by deterioration or wear of the closure elements.

Having thus described my invention in a specific embodiment, I claim:

1. A garment hanger, comprising:

a. a pair of separate gripping bars disposed parallel to each other, b. a wire hook assembly including a pair of elongated, substantially parallel, resilient wires each secured at one end to one of the gripping bars and joined together at the opposite ends in a manner to urge the attached gripping bars apart resiliently, c. transverse shoulder members intermediate the ends of the pair of wires extending substantially parallel to the gripping bars, and d. a closure member secured at one end pivotally to one of the shoulder members on opposite sides of the associated wire, the closure member having an intermediate pocket for releasably securing therein the other of said shoulder members, and an elongated central opening freely receiving said other wire, the end of the closure member opposite its pivotally secured end forming a finger grip for moving the closure member between shoulder-engaging and shoulder-releasing positions.

2. The garment hanger of claim 1 wherein the wire hook assembly comprises a pair of U-shaped wires the spaced ends of each of which are secured to the associated gripping bar and the closed end of each of which forms the transverse shoulder member, and a reversely bent length of wire, the spaced ends of which are secured rigidly one to each of said closed ends of the U-shaped wires and the closed end portion of which reversely bent wire is bent to form a hanger hook, the reversely bent length of hanger hook wire having its spaced end portions biased resiliently outward normally to urge said gripping bars apart.

3. The garment hanger of claim 2 wherein the closure member comprises a reversely bent length of wire straddling the spaced end portions of the reversely bent length of hanger hook wire of the hook assembly and formed at its spaced ends with pivot loops encircling the closed end of one of the pair of U-shaped wires on opposite sides of the hanger hook wire, the reversely bent length of closure member wire being bent intermediate its ends to form said pocket.

* * * * *